US007296557B2

(12) United States Patent
Wendel et al.

(10) Patent No.: US 7,296,557 B2
(45) Date of Patent: Nov. 20, 2007

(54) FINAL CONTROL ELEMENT FOR A CONTROL UNIT

(75) Inventors: Friedrich Wendel, Weissach (DE); Reiner Schweinfurth, Eppingen (DE); Johannes Meiwes, Markgroeningen (DE); Udo Utz, Ditzingen (DE); Michael Knorpp, Weissach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/476,139

(22) Filed: Jun. 28, 2006

(65) Prior Publication Data

US 2007/0006846 A1 Jan. 11, 2007

(30) Foreign Application Priority Data

Jul. 5, 2005 (DE) ..... 10 2005 031 341

(51) Int. Cl.
*F02D 41/04* (2006.01)
*F02D 9/10* (2006.01)

(52) U.S. Cl. ..... 123/399; 123/361; 123/396

(58) Field of Classification Search ..... 123/399, 123/398, 361, 360, 337, 396; 73/118.1; 74/504, 74/513; 180/179
See application file for complete search history.

(56) References Cited

U.S. PATENT DOCUMENTS 4,831,985 A * 5/1989 Mabee et al. ..... 123/399
5,168,951 A * 12/1992 Sugiura et al. ..... 180/197
6,543,417 B2 * 4/2003 Tanaka et al. ..... 123/399

* cited by examiner

*Primary Examiner*—Stephen K. Cronin
*Assistant Examiner*—Johnny H. Hoang
(74) *Attorney, Agent, or Firm*—Ronald E. Greigg

(57) ABSTRACT

A final control element for a control unit, for a throttle body located in a conduit carrying a gaseous medium in an internal combustion engine, is disclosed which has a control shaft, supporting the control unit in a manner fixed against relative rotation; a power takeoff member of a final control element gear, the power takeoff member being seated on the control shaft in a manner fixed against relative rotation; and an error sensor, detecting the rotary position of the control shaft, with a rotor part that is connected to the control shaft in a manner fixed against relative rotation. The error sensor is a contactless measurement rotary angle sensor, whose rotor part is integrated by material and positive engagement with the drive member. Preferably, the rotor part is made of sheet metal, and the positive engagement is established by spraying the power takeoff member, made of plastic, onto it. The rotor part is welded to the control shaft.

19 Claims, 2 Drawing Sheets

FINAL CONTROL ELEMENT FOR A CONTROL UNIT

REFERENCE TO FOREIGN PATENT APPLICATION

This application is based on German Patent Application 10 2005 031 341.8 filed Jul. 5, 2005, upon which priority is claimed.

BACKGROUND OF THE INVENTION

1. Field of the Invention

The invention is based on a final control element for a control unit, in particular for a throttle body disposed in a conduit, carrying gaseous medium, in an internal combustion engine.

2. Description of the Prior Art

In a known throttle body adjusting unit, having a control shaft supported rotatably in a throttle body brace, the throttle body being secured to the control shaft (German Patent Disclosure DE 195 25 510 A1), a gear wheel, which can be driven via an intermediate wheel by a motor pinion seated on the driven shaft of an electric control motor, is secured to the control shaft outside a gas-carrying conduit whose open cross section is uncovered to a variable extent by the throttle body depending on the rotary position of the control shaft. The error sensor for detecting the rotary angle position of the control shaft is embodied as a potentiometer, with a wiper assembly as the rotor part and with a wiper track assembly as the stator part. The wiper assembly, secured to the face end of the gear wheel, facing away from the gas conduit, includes four wipers, and the wiper track assembly, located on the housing cap of the final control element housing, includes four circular wiper tracks. One wiper presses against each wiper track with spring prestressing.

OBJECT AND SUMMARY OF THE INVENTION

The final control element according to the invention has the advantage that because the error sensor is embodied as a contactless measurement rotary angle sensor and the power takeoff member of the final control element gear and the rotor part of the rotary angle sensor are combined into a single unit, the production and installation of the final control element are simplified, and the final control element is more-compact and thus saves more space.

In a preferred embodiment of the invention, the rotor part is embodied as a fastening part, which supports the power takeoff wheel and by way of which the connection of the power takeoff wheel with the control shaft in a manner fixed against relative rotation can be made. The rotor part thus simultaneously takes on a supporting function for the power takeoff member of the control unit and, once the rotor part is secured to the control shaft, the drive member is thus fixed as well.

In an advantageous embodiment of the invention, the material and positive engagement between the rotor part and the power takeoff member is produced by means of spraying the plastic power takeoff member onto the rotor part. This makes especially economical manufacture of the dual-function component possible; in the production of the power takeoff member embodied as an injection-molded plastic part, the rotor part is placed in the injection mold.

For securing the rotor part to the control shaft, the rotor part has an inner ring, located coaxially in the power takeoff member and forming a hub of the drive member, and with this inner ring the dual-function component is slipped onto the control shaft and fixed on the control shaft.

In a preferred embodiment of the invention, the rotor part is made from sheet metal, and the plastic of the power takeoff member is injected onto the sheet metal in such a way that one sheet-metal plane is exposed on the face end in the power takeoff member. In the region of the inner ring, the sheet metal is welded to the metal control shaft, for which purpose, between the inner ring and the rotor shaft, a weld bead is produced which extends at least in segments, spaced apart from one another, around the circumference.

BRIEF DESCRIPTION OF THE DRAWINGS

The invention will be better understood and further objects and advantages thereof will become more apparent from the ensuing detailed description of a preferred embodiment contained herein below, taken in conjunction with the drawings, in which.

DESCRIPTION OF THE PREFERRED EMBODIMENTS

Figure 1:
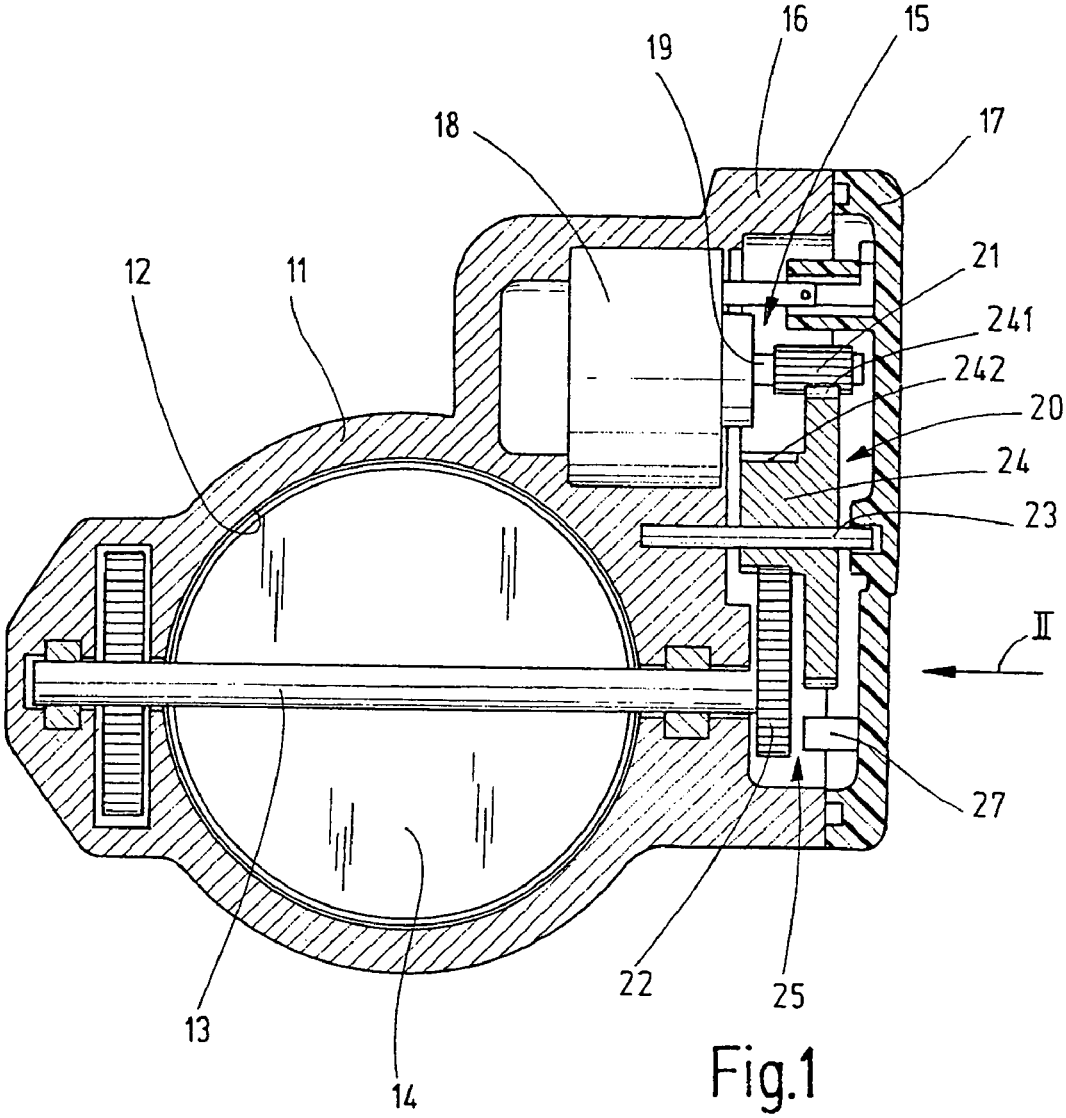
FIG. 1 is a longitudinal section through a throttle body brace, with a throttle body and a throttle body final control element.

FIG. 1, in section, shows a throttle body brace 11 with a gas conduit 12, which leads for instance from an air filter, not shown, to a combustion chamber, not shown, or to a plurality of combustion chambers of an internal combustion engine, also not shown. Air or a fuel-air mixture flows through the gas conduit 12. A control shaft 13, which is pivotably supported in the throttle body brace 11, extends through the gas conduit 12. A throttle body 14 is secured to the control shaft 13; by pivoting of the control shaft 13 by 90°, the throttle body can be pivoted into two terminal positions. In one of the two terminal positions, the throttle body 14 closes the gas conduit 12 virtually completely.

The control shaft 13 is part of a final control element 15, which is received in a final control element housing 16 integrally formed onto the throttle body brace 11. The final control element housing 16 is covered by a housing cap 17. The final control element 15 has an electric control motor 18 with a power takeoff shaft 19, which rotates the control shaft 13 via a final control element gear 20. The final control element gear 20 includes a motor pinion 21, seated on the power takeoff shaft 19 in a manner fixed against relative rotation; a power takeoff member 22, seated on the control shaft 13 in a manner fixed against relative rotation; and an intermediate wheel 24 supported on a shaft 23 in a manner fixed against relative rotation. The shaft 23 is fixed in the final control element housing 16 and in the housing cap 17. The intermediate wheel 24 has two sets of external teeth 241 and 242, extending all the way around and located axially next to one another, with greatly differing numbers of teeth. The external set of teeth 241 meshes with the motor pinion 21, and the external set of teeth 242 is in engagement with the power takeoff member 22, which for this purpose is embodied as a gear wheel segment, with a set of external teeth 221 extending over part of the circumference.

Figure 4:
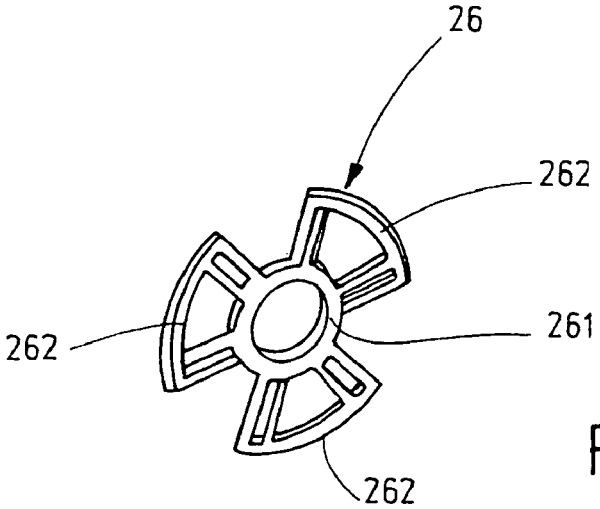
FIG. 4 is a perspective view of the rotor part of a contactless measurement rotary angle sensor in the throttle body final control element of FIG. 1.
Figure 2:
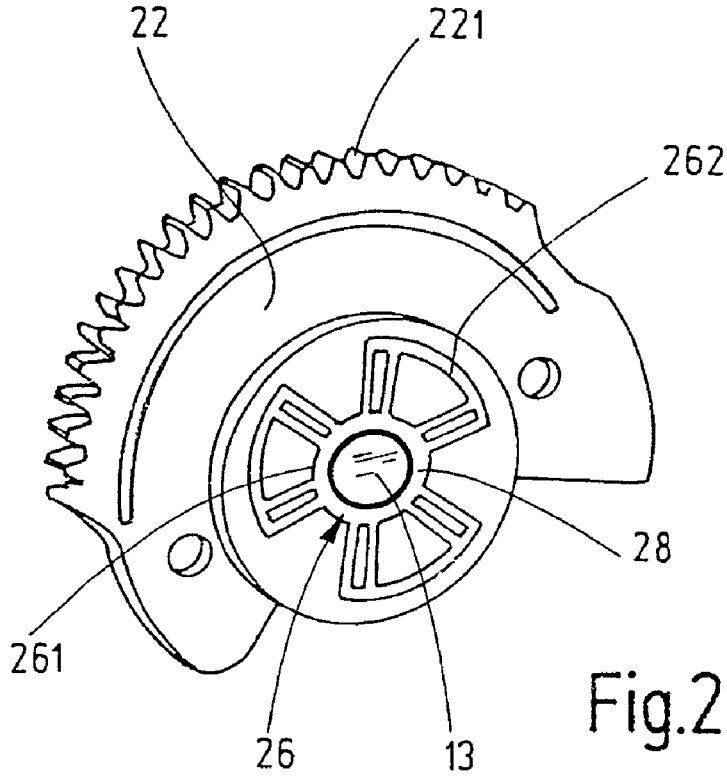
FIG. 2 is a top view in the direction of arrow II through a gear part of the final control element gear in FIG. 1, shown in perspective.
Figure 3:
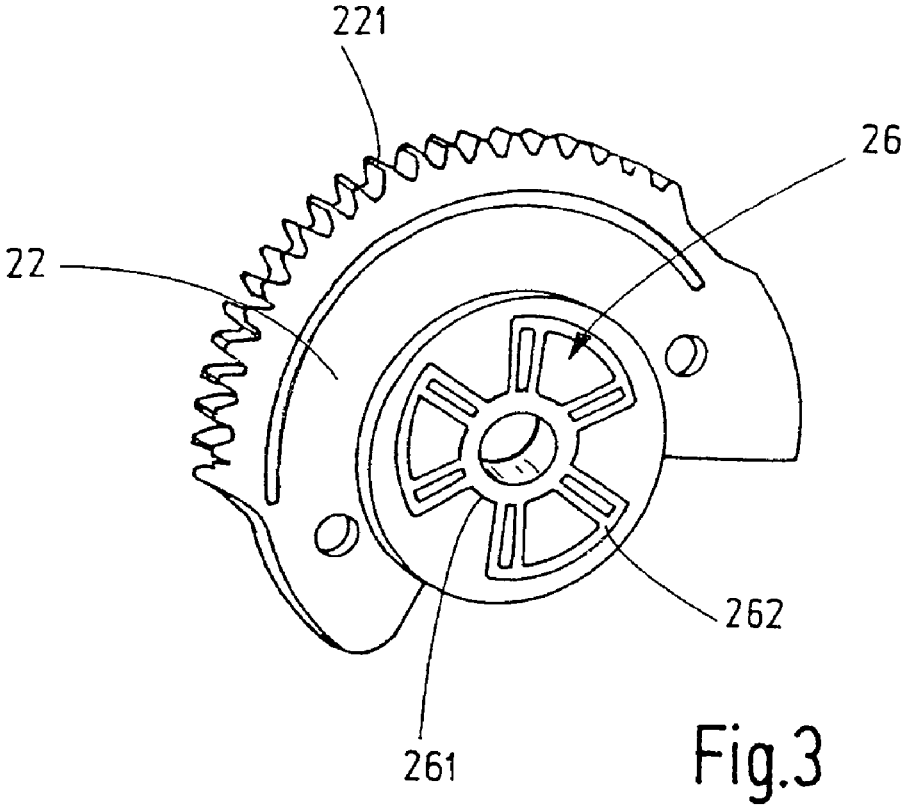
FIG. 3 is a view identical to FIG. 2 of the gear part removed from the control shaft.

For detecting the pivoted position of the control shaft 13, an error sensor is provided, which is embodied as a contactless measurement rotary angle sensor 25, which detects the rotary angle position inductively, for instance. For this purpose, the rotary angle sensor 25 has a rotor part 26 (FIG. 4), rotating with the control shaft 13, and a spatially fixed stator part 27, cooperating with the rotor part, that is secured to the housing cap 17. For achieving a compact structure of the final control element 15 that can be produced economically, the rotor part 26—as shown in FIGS. 2 and 3—is integrated or embedded in the power takeoff member 22 by material and positive engagement in such a way that the rotor part 26 forms a supporting and fastening part for the power takeoff member 22, by way of which the connection of the power takeoff member 22 to the control shaft 13 in a manner fixed against relative rotation is made. The rotor part 26 is preferably made from a sheet metal, for instance as a stamped sheet-metal part, and has an inner ring 261, located coaxially in the power takeoff member 22 and forming the hub of the power takeoff member 22, and three rotor vanes 262, which are integral with the inner ring 261 and protrude radially outward and are offset from one another on the inner ring 261 by equal circumferential angles. The material and positive engagement between the rotor part 26 and the power takeoff member 22 is preferably accomplished by spraying the plastic power takeoff member 22 onto the stamped sheet-metal part; the plastic is sprayed onto the stamped sheet-metal part in such a way that one sheet-metal plane is exposed (FIG. 3). The component thus produced by injection molding, with the dual function of the power takeoff member 22 of the final control element gear 20 and the rotor part 26 of the rotary angle sensor 25, is slipped onto the metal control shaft 13 (FIG. 2), and for fixation of this component on the control shaft 13, the inner ring 261 of the rotor part 26 is welded to the control shaft 13. The welding is done by making a weld bead 28 (FIG. 2), which joins the inner ring 261 to the control shaft 13 by material engagement. The weld bead 28 may be embodied as extending all the way around, as shown in FIG. 2. However, it may also be embodied only in portions or segments.

The final control element 15 described may also be used as an actuator for an exhaust gas recirculation valve, with which the proportion of exhaust gas added to the fresh air is controlled. It can also be used in an exhaust gas turbocharger, in which to increase the charge pressure of the aspirated atmospheric air, a compressor is driven by a turbine subjected to exhaust gas. The throttling device actuated by the final control element 15 is located in a bypass, by way of which a portion of the exhaust gas flowing to the turbine is made to bypass the turbine.

The foregoing relates to a preferred exemplary embodiment of the invention, it being understood that other variants and embodiments thereof are possible within the spirit and scope of the invention, the latter being defined by the appended claims.

We claim:

1. A final control element for a control unit, in particular for a throttle body located in a gaseous medium-carrying conduit of an internal combustion engine, having a control shaft carrying the control unit in a manner fixed against relative rotation, having a power takeoff member, seated on the control shaft in a manner fixed against relative rotation, of a final control element gear that rotates the control shaft, and having an error sensor, detecting the rotary position of the control shaft, which error sensor has a rotor part, connected to the control shaft in a manner fixed against relative rotation, and a spatially fixed stator part, the improvement wherein the error sensor is a rotary angle sensor which measures without contact, and whose rotor part is embedded by material and positive engagement in the power takeoff member of the final control element gear.

2. The final control element as recited in claim 1, wherein the rotor part is embodied as a fastening part, which supports the power takeoff member and by way of which the connection of the power takeoff member with the control shaft in a manner fixed against relative rotation can be made.

3. The final control element as recited in claim 2, wherein the rotor part comprises a coaxial inner ring, forming a hub of the power takeoff member, for being slipped onto and fixed on the control shaft.

4. The final control element as recited in claim 1, wherein the power takeoff member is made of plastic and the material and positive engagement is produced by means of spraying the plastic power takeoff member onto the rotor part.

5. The final control element as recited in claim 3, wherein the power takeoff member is made of plastic and the material and positive engagement is produced by means of spraying the plastic power takeoff member onto the rotor part.

6. The final control element as recited in claim 4, wherein the rotor part is a sheet-metal part, and wherein the plastic is injected onto the sheet-metal part in such a way that one sheet-metal plane is exposed.

7. The final control element as recited in claim 5, wherein the rotor part is a sheet-metal part, and wherein the plastic is injected onto the sheet-metal part in such a way that one sheet-metal plane is exposed.

8. The final control element as recited in claim 6, wherein the control shaft is made of metal and the sheet-metal part and the metal control shaft are welded to one another.

9. The final control element as recited in claim 7, wherein the control shaft is made of metal and the sheet-metal part and the metal control shaft are welded to one another.

10. The final control element as recited in claim 8, further comprising a weld bead produced in at least some portions between the rotor part and the control shaft.

11. The final control element as recited in claim 3, further comprising rotor vanes integral with the inner ring and extending radially outward from the inner ring, the rotor vanes being offset from one another by equal circumferential angles on the inner ring.

12. The final control element as recited in claim 5, further comprising rotor vanes integral with the inner ring and extending radially outward from the inner ring, the rotor vanes being offset from one another by equal circumferential angles on the inner ring.

13. The final control element as recited in claim 7, further comprising rotor vanes integral with the inner ring and extending radially outward from the inner ring, the rotor vanes being offset from one another by equal circumferential angles on the inner ring.

14. The final control element as recited in claim 9, further comprising rotor vanes integral with the inner ring and extending radially outward from the inner ring, the rotor vanes being offset from one another by equal circumferential angles on the inner ring.

15. The final control element as recited in claim 1, wherein the power takeoff member comprises an external set of teeth, extending over at least part of its circumference.

16. The final control element as recited in claim 3, wherein the power takeoff member comprises an external set of teeth, extending over at least part of its circumference.

17. The final control element as recited in claim 6, wherein the power takeoff member comprises an external set of teeth, extending over at least part of its circumference.

18. The final control element as recited in claim 8, wherein the power takeoff member comprises an external set of teeth, extending over at least part of its circumference.

19. The final control element as recited in claim 1, wherein the control unit is a throttle body, disposed in a throttle body brace for delivering air or air and fuel to at least one combustion chamber of an internal combustion engine; and that the control shaft is pivotably supported in the throttle body brace.

* * * * *